US008348608B2

(12) United States Patent
Willett et al.

(10) Patent No.: US 8,348,608 B2
(45) Date of Patent: Jan. 8, 2013

(54) TURBOMACHINE ROTOR COOLING

(75) Inventors: Fred Thomas Willett, Burnt Hills, NY (US); Howard Michael Brilliant, Niskayuna, NY (US); Pepe Palafox, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 610 days.

(21) Appl. No.: 12/578,691

(22) Filed: Oct. 14, 2009

(65) Prior Publication Data

US 2011/0085905 A1 Apr. 14, 2011

(51) Int. Cl.
*F01D 5/08* (2006.01)
*F01D 5/18* (2006.01)

(52) U.S. Cl. ..... 416/1; 416/96 R; 416/97 R; 416/193 A; 415/100; 415/115; 415/116; 415/177; 415/220

(58) Field of Classification Search ..... 415/100, 415/115, 116, 177, 220; 416/96 R, 97 R, 416/193 A See application file for complete search history.

(56) References Cited

U.S. PATENT DOCUMENTS

| | | | | |
|---|---|---|---|---|
| 2,041,699 | A * | 5/1936 | Dahlstrand | 415/214.1 |
| 2,552,239 | A * | 5/1951 | Warren | 415/112 |
| 4,551,063 | A * | 11/1985 | Raschke et al. | 415/115 |
| 7,101,144 | B2 | 9/2006 | Haje et al. | |
| 7,488,153 | B2 | 2/2009 | Reigl | |
| 2005/0163612 | A1 * | 7/2005 | Reigl | 415/198.1 |

* cited by examiner

*Primary Examiner* — Igor Kershteyn
(74) *Attorney, Agent, or Firm* — Cantor Colburn LLP

(57) ABSTRACT

A rotor of a turbomachine includes a rotor drum located at a central axis and a plurality of buckets secured to the rotor drum. A rotor shell extends between axially adjacent buckets of the plurality of buckets and is secured to and supported by the plurality of buckets defining a cooling passage between the rotor drum and the rotor shell. A low pressure sink is located at an upstream end of the rotor receptive of a coolant flow through the cooling passage. A method of cooling a rotor of a steam turbine includes locating a rotor shell radially outboard of a rotor drum defining a cooling passage therebetween. A flow of steam is urged from a downstream portion of the steam turbine through the cooling passage toward a low pressure sink located at an upstream end of the steam turbine thereby cooling the rotor.

17 Claims, 3 Drawing Sheets

TURBOMACHINE ROTOR COOLING

BACKGROUND OF THE INVENTION

The subject matter disclosed herein generally relates to turbomachine rotors. More specifically, the present disclosure relates to cooling of steam turbine rotors.

As steam turbine systems rely on higher steam temperatures to increase efficiency, steam turbines, especially those utilizing drum rotor construction, must be able to withstand the higher steam temperatures so as not to compromise the useful life of the rotor. Materials that are more temperature-resistant may be used in the rotor construction, but use of such materials often substantially increases the cost of rotor components. High pressure, lower temperature steam may be used as a coolant for the rotor, but use of this coolant, from a source outside of the gas turbine, but this too can significantly increase cost of the rotor and degrades the rotor performance.

The art would well receive a lower cost solution for improving the high temperature resistance of the rotor while having a reduced negative impact on performance of the rotor.

BRIEF DESCRIPTION OF THE INVENTION

According to one aspect of the invention, a rotor of a steam turbine includes a rotor drum located at a central axis and a plurality of buckets secured to the rotor drum. A rotor shell extends between axially adjacent buckets of the plurality of buckets and is secured to and supported by the plurality of buckets defining a cooling passage between the rotor drum and the rotor shell. A low pressure sink is located at an upstream end of the rotor receptive of a coolant flow through the cooling passage.

According to another aspect of the invention, a steam turbine includes a stator disposed at a central axis; and a rotor disposed radially inboard of the stator. The rotor includes a rotor drum and a plurality of buckets secured to the rotor drum. A rotor shell extends between axially adjacent buckets of the plurality of buckets, and is secured to and supported by the plurality of buckets defining a cooling passage between the rotor drum and the rotor shell. A low pressure sink is located at an upstream end of the rotor receptive of a coolant flow through the cooling passage.

According to yet another aspect of the invention, a method of cooling a rotor of a steam turbine includes locating a rotor shell radially outboard of a rotor drum defining a cooling passage therebetween. The rotor shell extends between axially adjacent buckets of a plurality of buckets, and is secured to and supported by the plurality of buckets. A flow of steam is urged from a downstream portion of the steam turbine through the cooling passage toward a low pressure sink located at an upstream end of the steam turbine thereby cooling the rotor.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
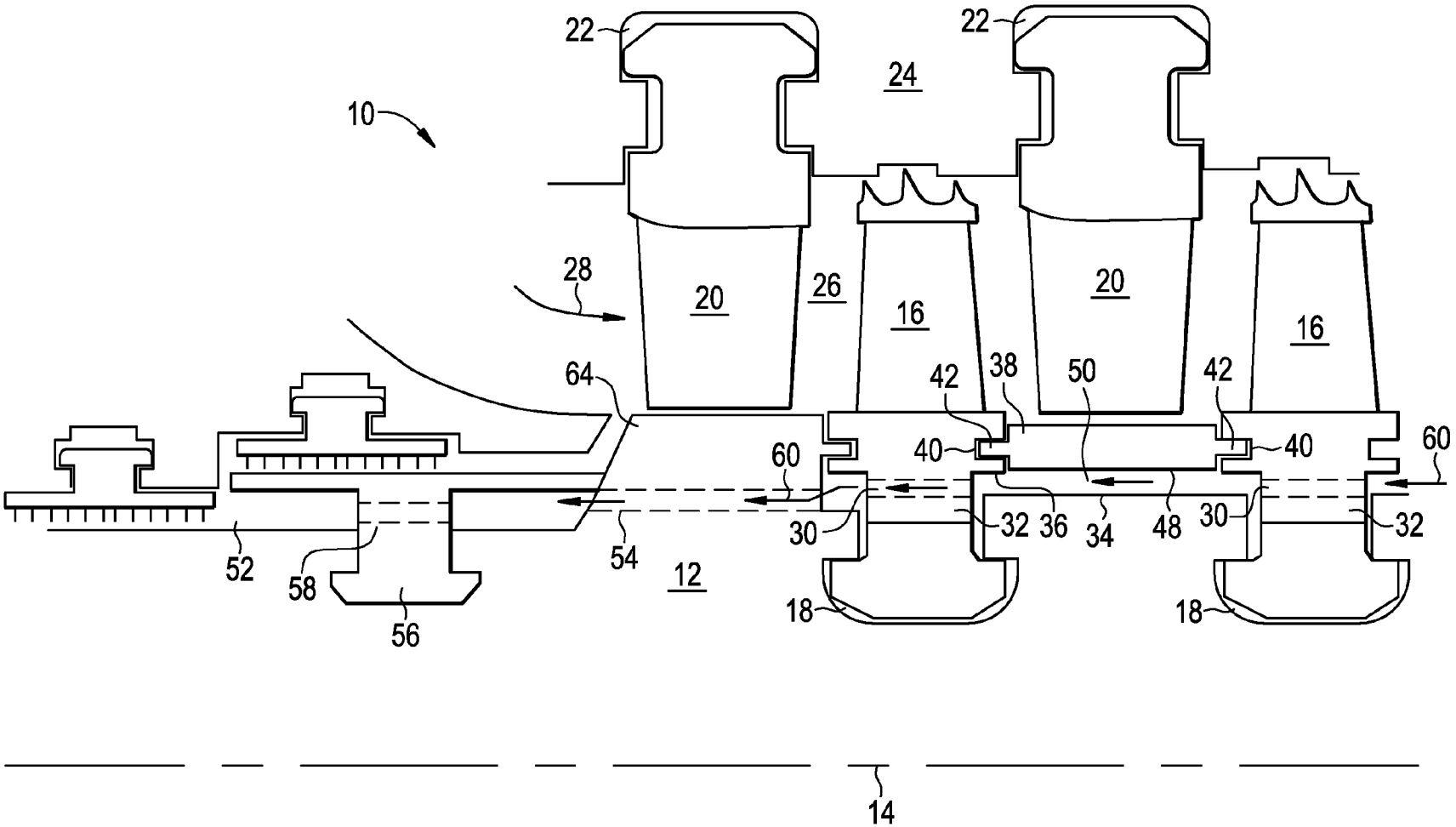
FIG. 1 is a partial cross-sectional view of an embodiment of a steam turbine.

Shown in FIG. 1 is an embodiment of a turbomachine, for example, a steam turbine 10. The steam turbine 10 includes a rotor 12 rotatably disposed at an axis 14 of the steam turbine. A plurality of buckets 16 are secured in a plurality of bucket slots 18 in a rotor drum 64 and are typically arranged in a number of rows, or stages, that extend around a circumference of the rotor 12 at axial locations along the rotor 12. A plurality of stationary nozzles 20 are secured in a plurality of nozzle slots 22 in a stator 24 of the steam turbine 10. For example, the nozzle slots may be located in an inner carrier 64 of the stator 24. The nozzles 20 are arranged in circumferential stages that are located between stages of buckets 16. The rotor 12 and the stator 24 define a primary flowpath 26 therebetween. A fluid, for example, steam 28 is directed along the primary flowpath 26, which urges rotation of the rotor 12 about the axis 14.

Figure 2:
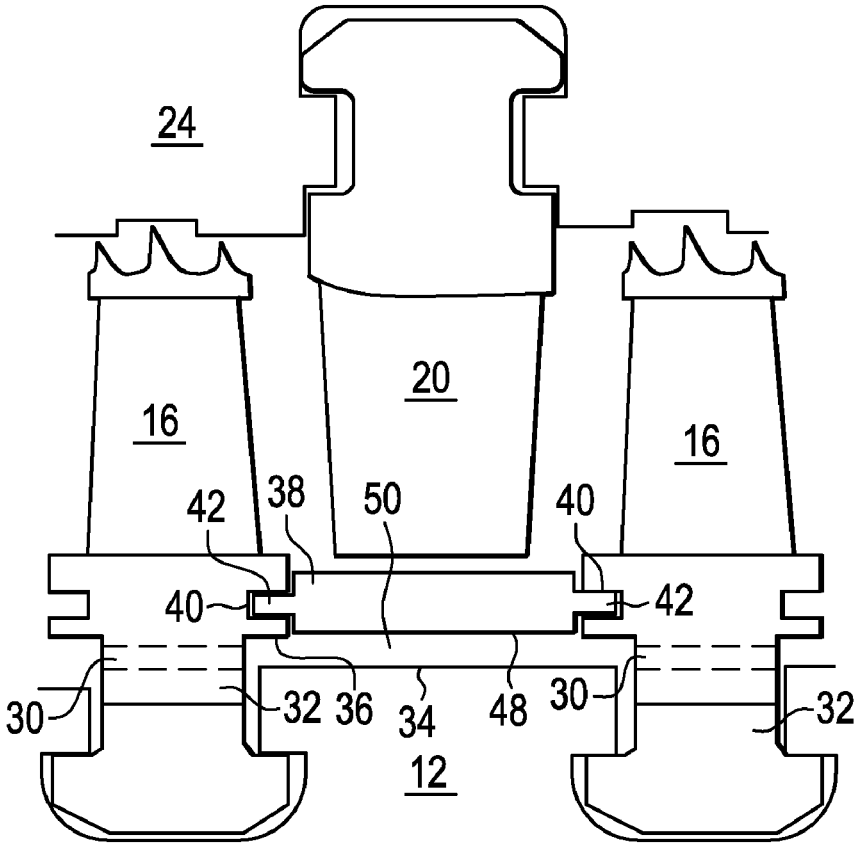
FIG. 2 is an enlarged view of a portion of FIG. 1.
Figure 3:
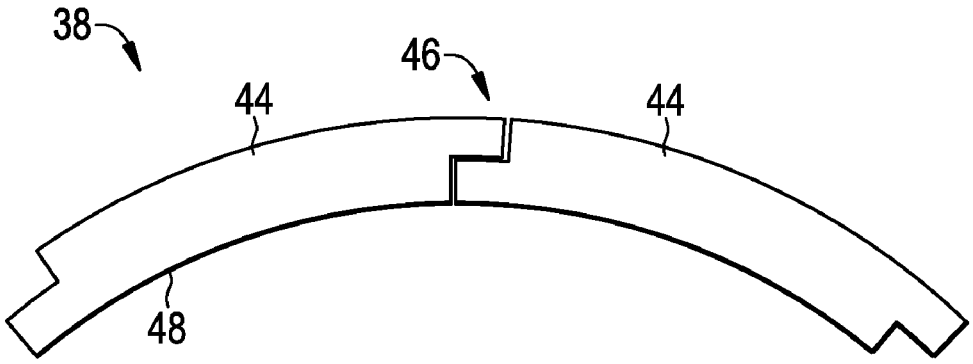
FIG. 3 is a cross-sectional view of an embodiment of a rotor shell for a steam turbine.

Referring now to FIG. 2, each bucket 16 has an axially-extending through hole 30 through a shank 32 of the bucket 16. The hole 30 is configured to be radially outboard of a radially outer rotor surface 34 and radially inboard of a platform 36 of the bucket 16. A shell 38 extends axially between platforms 36 of buckets 16 of consecutive stages of the rotor 12. The shell 38 is attached to and supported by the platforms 36 by one of any suitable means. For example, in some embodiments, each platform 36 may have a groove 40 extending axially into the platform 36. The shell 38 has complimentary tabs 42 at the axial ends of the shell 38 which are insertable into the groove 40. It is to be appreciated that while one groove 40 and one tab 42 are shown at each shell 38 end in FIG. 2, other quantities of tabs 42 and grooves 40, for example two or three, are contemplated within the present scope. Further, in some embodiments, the connection arrangement may be substantially reversed, with the grooves 40 being located at the shell 38 and the tabs 42 located at the platforms 36. Referring now to FIG. 3, the shell 38 extends around the circumference of the rotor 12 and may be formed of a plurality of shell segments 44, for example two, four or six shell segments 44. In some embodiments, the shell segments 44 may have a joint 46 configuration which reduces leakage between the shell segments 44. For example, as shown the joint 46 may be a lap joint.

Referring again to FIG. 2, a radially inboard shell surface 48 and the rotor surface 34 define a cooling passage 50 therebetween between bucket 16 stages. The cooling passage 50 continues through each bucket 16 stage via the through hole 30. Referring again to FIG. 1, the cooling passage 50 extends from an axially downstream location, upstream along the rotor 12 toward a low pressure sink 52. In some embodiments, the low pressure sink 52 is located at an upstream end of the steam turbine 10. An axially-directed through rotor hole 54 extends through the rotor 12 upstream of the first bucket 16 stage. One or more seal rings 56 are disposed upstream of the rotor hole 54 and include a plurality of seal ring holes 58 through which the cooling passage 50 to the low pressure sink 52.

Figure 4:
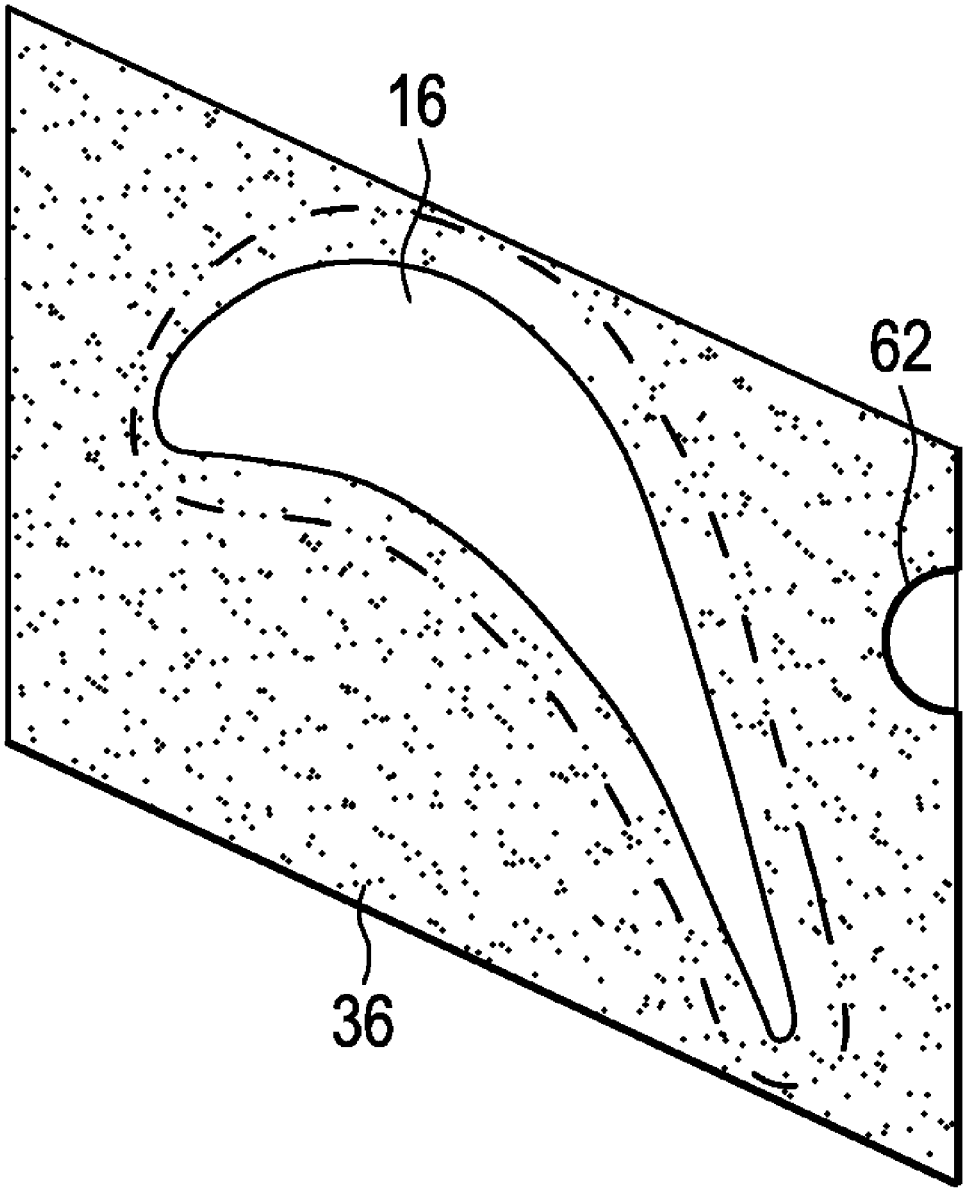
FIG. 4 is a plan view of a rotor bucket for a steam turbine.

In some embodiments, a steam flow 60 from at least one downstream bucket 16 stage is introduced into the cooling passage 50. Referring to FIG. 4, one or more of the platforms 36 include a scalloped coolant opening 62 which extends from the primary flowpath 26 through the platform 36. Referring again to FIG. 1, steam flow 60 into the scalloped steam opening is driven by a pressure differential between the primary flowpath 26 at the scalloped coolant opening 62 and the low pressure sink 52. The steam flow 60 enters the coolant opening 62, a relatively high pressure location, and flows through the cooling passage 50 toward the low pressure sink 52, a relatively low pressure location. Since the steam flow 60 flows through the upstream stages prior to reaching the coolant opening 62, the steam flow 60 entering the coolant opening 62 is at a lower temperature than the steam flow 60 at the upstream stages. The lower temperature steam flow 60 flowing through the cooling passage 50 removes heat from the rotor 12.

In some embodiments, the coolant opening 62 is omitted and the shell 38 merely isolates the rotor 12 from the steam flow 60 in the primary flowpath 26. This isolation of the rotor 12 results in a more closely matched thermal response between the rotor 12 and the stator 24 which reduces differential thermal expansion between the rotor 12 and stator 24 allowing for tighter axial clearances.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A rotor of a turbomachine comprising:

a rotor drum disposed at a central axis;

a plurality of buckets secured to the rotor drum;

a rotor shell extending between axially adjacent buckets of the plurality of buckets, the rotor shell secured to and supported by the plurality of buckets defining a cooling passage between the rotor drum and the rotor shell;

at least one coolant opening extending from a primary rotor flowpath through a platform of a bucket of the plurality of buckets to allow entry of the coolant flow into the cooling passage and a low pressure sink disposed at an upstream end of the rotor receptive of a coolant flow through the cooling passage.

2. The rotor of claim 1 wherein the rotor is a rotor of a steam turbine.

3. The rotor of claim 2 wherein the coolant flow comprises steam routed into the cooling passage from a downstream portion of the steam turbine.

4. The rotor of claim 1 comprising at least one rotor through hole extending from the cooling passage to the low pressure sink.

5. The rotor of claim 1 comprising at least one bucket hole extending through the shank of a bucket disposed outboard of the rotor drum and inboard of the rotor shell.

6. The rotor of claim 1 wherein the rotor shell comprises a plurality of rotor shell segments arranged circumferentially around the rotor hub.

7. The rotor of claim 1 wherein the rotor shell is secured to platforms of the rotor buckets.

8. The rotor of claim 7 wherein the rotor shell is secured to the platforms via a tongue and groove configuration.

9. A steam turbine comprising:

a stator disposed at a central axis; and a rotor disposed radially inboard of the stator including:

a rotor drum;

a plurality of buckets secured to the rotor drum;

a rotor shell extending between axially adjacent buckets of the plurality of buckets, the rotor shell secured to and supported by the plurality of buckets defining a cooling passage between the rotor drum and the rotor shell;

at least one steam opening extending from a primary rotor flowpath through a platform of a bucket of the plurality of buckets to allow entry of the coolant flow into the cooling passage; and a low pressure sink disposed at an upstream end of the rotor receptive of a coolant flow through the cooling passage.

10. The steam turbine of claim 9 wherein the coolant flow comprises steam routed into the cooling passage from a downstream portion of the steam turbine.

11. The steam turbine of claim 9 comprising at least one rotor through hole extending from the cooling passage to the low pressure sink.

12. The steam turbine of claim 9 comprising at least one bucket hole extending through the shank of a bucket disposed outboard of the rotor drum and inboard of the rotor shell.

13. A method of cooling a rotor of a steam turbine comprising:

disposing a rotor shell radially outboard of a rotor drum defining a cooling passage therebetween, the rotor shell extending between axially adjacent buckets of a plurality of buckets, the rotor shell secured to and supported by the plurality of buckets;

urging a flow of steam into the cooling passage through at least one steam opening extending from a primary rotor flowpath through a platform of a bucket of the plurality of buckets;

urging the flow of steam from a downstream portion of the steam turbine through the cooling passage toward a low pressure sink disposed at an upstream end of the steam turbine thereby cooling the rotor.

14. The method of claim 13 comprising urging the flow of steam through the cooling passage via a pressure difference between the downstream portion and the low pressure sink.

15. The method of claim 13 comprising flowing the flow of steam through at least one rotor through hole extending from the cooling passage to the low pressure sink.

16. The method of claim 13 wherein the rotor shell is secured to platforms of the rotor buckets.

17. The method of claim 13 comprising flowing the steam flow through at least one bucket hole extending through the shank of a bucket disposed outboard of the rotor drum and inboard of the rotor shell.

* * * * *